US011129473B2

(12) United States Patent
Held

(10) Patent No.: US 11,129,473 B2
(45) Date of Patent: Sep. 28, 2021

(54) RACK

(71) Applicant: Wolfgang Held, Hard (AT)

(72) Inventor: Wolfgang Held, Hard (AT)

( * ) Notice: Subject to any disclaimer, the term of this patent is extended or adjusted under 35 U.S.C. 154(b) by 50 days.

(21) Appl. No.: 16/605,386

(22) PCT Filed: Apr. 18, 2018

(86) PCT No.: PCT/EP2018/059898
§ 371 (c)(1),
(2) Date: Oct. 15, 2019

(87) PCT Pub. No.: WO2018/192969
PCT Pub. Date: Oct. 25, 2018

(65) Prior Publication Data

US 2020/0121077 A1 Apr. 23, 2020

(30) Foreign Application Priority Data

Apr. 18, 2017 (EP) ..... 17166870

(51) Int. Cl.
*A47B 49/00* (2006.01)
*A47B 88/40* (2017.01)
*A47B 96/06* (2006.01)

(52) U.S. Cl.
CPC ..... *A47B 49/006* (2013.01); *A47B 88/40* (2017.01); *A47B 96/06* (2013.01); *A47B 2220/0011* (2013.01)

(58) Field of Classification Search
CPC .. A47L 88/40; A47L 96/06; A47L 2220/0011; A47L 81/002; A47L 49/006; A47L 49/004; A47L 49/00
USPC ..... 312/238
See application file for complete search history.

(56) References Cited

U.S. PATENT DOCUMENTS 4,124,262 A * 11/1978 Schill ..... A47B 49/004 16/378
4,146,280 A * 3/1979 Crownhart ..... A47B 49/006 108/94
4,440,459 A * 4/1984 Hallgren ..... A47B 49/006 108/94
4,582,372 A * 4/1986 Cooper ..... A47B 46/00 108/140
5,249,856 A * 10/1993 Dreier ..... A47B 49/006 211/163

(Continued)

FOREIGN PATENT DOCUMENTS

DE 102012007306 A1 10/2013
EP 0873702 A1 10/1998

(Continued)

*Primary Examiner* — Patrick D Hawn
(74) *Attorney, Agent, or Firm* — John Alumit

(57) ABSTRACT

The invention relates to a rack for a cabinet, preferably a corner cabinet, comprising at least two shelves, which can be rotated about an axis and can be slid transversely to the axis. The shelves can be operated independently of each other, can be arranged one over the other, and can be slid on shelf supports. The shelves are mounted on the shelf supports in such a way that rotation by 360° is enabled. Each shelf not mounted on a bottom of the cabinet is mounted on at least one support, which can be fastened to a stable wall in a rear region of the cabinet and is arranged in such a way that the height of the support can be varied.

2 Claims, 9 Drawing Sheets

(56) References Cited

U.S. PATENT DOCUMENTS

| | | | | | |
|---|---|---|---|---|---|
| 5,662,398 | A * | 9/1997 | Swallow | A47B 81/002 | 312/238 |
| 7,690,739 | B2 * | 4/2010 | Brustle | A47B 88/944 | 312/238 |
| 8,002,366 | B2 * | 8/2011 | Fitz | A47B 88/944 | 312/348.4 |
| 8,020,951 | B2 * | 9/2011 | Twellmann | A47B 81/002 | 312/238 |
| 2009/0267470 | A1 * | 10/2009 | Compagnucci | A47B 88/42 | 312/311 |

FOREIGN PATENT DOCUMENTS

| | | | | |
|---|---|---|---|---|
| EP | 1021974 | A2 * | 7/2000 | B65F 1/1426 |
| EP | 2078473 | A1 | 7/2009 | |
| GB | 977734 | A | 12/1964 | |
| JP | 05146325 | A * | 2/2013 | |

* cited by examiner

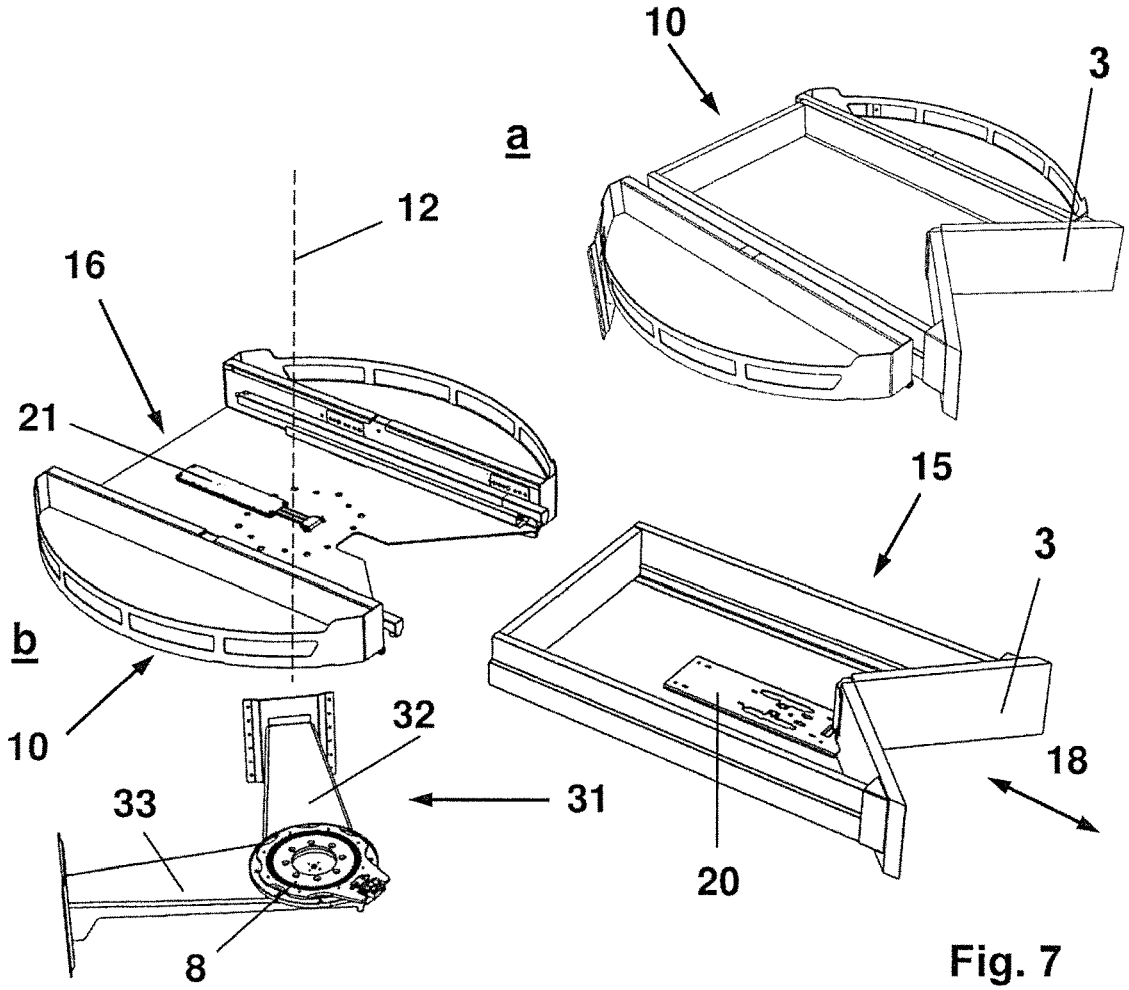
Fig. 7
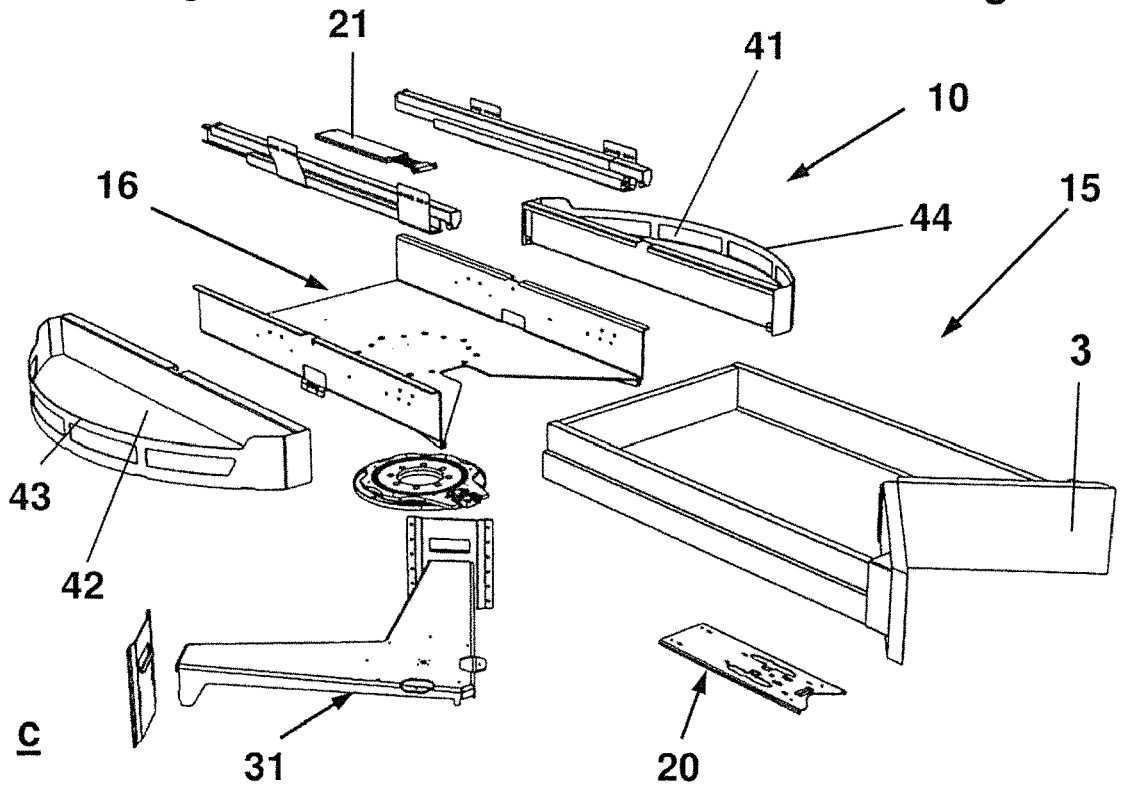

RACK

The invention relates to a rotatable rack as generically defined by the preamble to claim 1 and to a cabinet having such a rack as generically defined by the preamble to claim 1.

Conventional racks, of the kind described for instance in EP 873702, essentially involve a shelf carousel for corner cabinets. A central shelf support is provided, which can be slid out of the corner cabinet. In the slid-out state, the drawers located side by side are accessible and can be taken out of the shelf in the vertical direction. For two or more drawers, which are arranged one above the other, this rack is not suitable.

DE 10 2012 007 306 A1 describes a corner cabinet with a plurality of round panels located one above the other, which are mounted rotatably via a center axis and serve to set down everyday objects; the upper panels are secured to side walls of the corner cabinet via mounts. Front side walls of the corner cabinet form the facings of drawers, which can be adjusted individually on the panels and pulled out individually, and besides the drawers, other containers for everyday objects are secured to the panels, and these containers are used as pulled-out guides for the drawers, and the panels, with the containers and the back walls of the pushed-in drawers, complete the round cross section of individually rotatable circular trays. A disadvantage of this arrangement when structurally simple mounts are used is that the mounts bend when a load is put on the panels. Furthermore, the mounts allow rotation of the shelves by only about 90° in both directions.

Taking the prior art described above as the point of departure, the object of the invention is to improve the generic rack in such a way that it also has shelves or drawers, which are located one above the other and are accessible at all times and are movable while utilizing the maximum amount of available space.

This object is attained by the features recited in claim 1.

It will be seen that the invention is realized in any case if it involves a rack, preferably a shelf carousel, in which at least two shelves (drawers) that are rotatable about an axis and can be slid transversely to the axis are provided. These shelves can be pressed independently of one another, can be located one above the other, and can each be slid on a respective shelf support. As a result, it is possible for the rack to be used even for corner cabinets, and for the available space in the corner cabinet to be filled completely with shelves or drawers that can be pressed and accessed independently of one another. In particular, the 360° rotatability of the shelves that is possible permits the full utilization of the available space on a shelf.

Since this involves a multi-angled, preferably four- or five-sided cabinet, the inlet opening of which, located on the front side, involves two vertically extending side walls and two and more likewise vertically extending back walls, the interior of the cabinet can be optimally utilized. Between the two side walls, there is an inlet opening located on the front side and provided with facings, by which opening the access to the cabinet is made possible. At least two shelves, which are rotatable about an axis and can be slid transversely to it, are located centrally in the cabinet; they can be operated independently of one another and can be located one above the other. These shelves are located on shelf supports. The shelf support is retained by a support device that can be connected to at least one back wall and/or a stationary brace located opposite the inlet opening. If the support device is connected to one or more back walls of the cabinet that face away from the inlet opening, then the shelf support can be rotated or pivoted unhindered about its vertical axis in both directions without problems. All the shelf supports have a common, vertically extending axis of rotation; thus their mounts are in line with one another. The support device can, however, also be connected to a separate brace, which can be of metal, in particular aluminum or steel. This brace is then preferably located diametrically opposite the inlet opening and can be embodied in the form of a column, for instance in the form of a hollow cylinder or some other suitable geometrical body. In certain cases, it can be advantageous for the abutting point between the two back walls to be kept free, so that in this vicinity the cabinet is at least partially free and open, and the resultant gap is covered by the abutting point of two masonry walls located at right angles to one another, in which masonry the rack or cabinet is located. In that case, the brace is either formed by the masonry of the wall, or the connection between the brace and the kitchen wall is made by means of an auxiliary body, such as a profile piece. The profile piece is connected on the one hand to the masonry and on the other to the brace. In this case, no further aids are necessary in order to position the support device in stationary fashion inside the cabinet. Since the external form of the cabinet can be defined freely, the outer outline can be four-cornered, five-cornered or have even more sides in cross section, and an adaptation of the cabinet to the special geometry of the particular kitchen space is possible.

Other expedient and advantageous embodiments of the invention will become apparent from the dependent claims.

If the shelves are embodied such that they can be fixed in two, and preferably three different positions, then it is possible to slide all the drawers in and out of the rack at the same time and separately. There is furthermore the possibility of pivoting the rack in the closed state inside the corner cabinet.

Further optimization of the construction of the rack is the fact that the shelves can be rotated about a common vertical axis. With the shelves, horizontal motions back and forth can regularly be done, in which motions the drawers can be slid into and out of the rack. The individual drawers are provided with facings located on the front, which are adapted to the outer outline of the corner cabinet. When not in action, the facings form the face end of the corner cabinet; this face end is angular on the inside. When a light pressure is exerted on the facing, an axial pressure in the direction of the motion of the drawers inward is exerted on the facings. The facings are moved slightly inward, into the rack, and firmly held, and as a result the drawers can be rotated or pivoted about their own vertical axis.

When further pressure is exerted on the facing or drawer in the direction of the axis, the drawers are unlocked and move outward out of the rack.

Since the drawers can be pressed individually, the drawers can be slid out of the rack individually as well, and as a result they are accessible at any time, both from above and from the side.

The capability of the drawers to move and rotate is improved because they are located on mounts. If a plurality of shelf supports are located one above the other, then the bottom shelf is supported on a rotary mount, which in turn is located on the bottom of the corner cabinet. Between each two shelf supports there is one stationary support, which can be secured to the vertical walls of the corner cabinet and which supports a corresponding rotary mount for the second shelf support.

In order to ensure a horizontal position at all times even in drawers that are fully loaded, and even if the mounting supports are embodied in a simple version, the bottom shelf support is provided with a bracket, the horizontal support flange of which is spaced slightly apart from the top shelf support. The mounting support of the upper drawer can be braced on the top shelf support. This guarantees that the axes of all the rotary mounts are aligned even if all the drawers are holding unusually heavy everyday items.

In an alternative embodiment, an auxiliary support, on which the mount supports can be secured such that they can be adjusted in height, can be secured at least partially either on a rearward wall of the cabinet and/or a rear building wall, as a result of which it is unnecessary to use a bracket.

To enable full utilization of the interior space in the corner cabinet, a further expedient embodiment of the invention provides that the shelf support has auxiliary shelves located laterally of the shelf. These auxiliary shelves can advantageously be connected detachably to the shelf. In the simplest embodiment, they are suspended laterally on the shelf support.

The side of the auxiliary shelf that faces away from the shelf is curved.

The bracket and/or the support can have means for moving independently of one another, which means are embodied for instance as mounts (slide or roller mounts) and make it possible to move the bracket below the support.

One exemplary embodiment of the invention is schematically shown in the drawings and will be described in further detail hereinafter. In the drawings:

FIG. 7 shows the shelf support of FIG. 6 with a support and mount;

Figure 1:
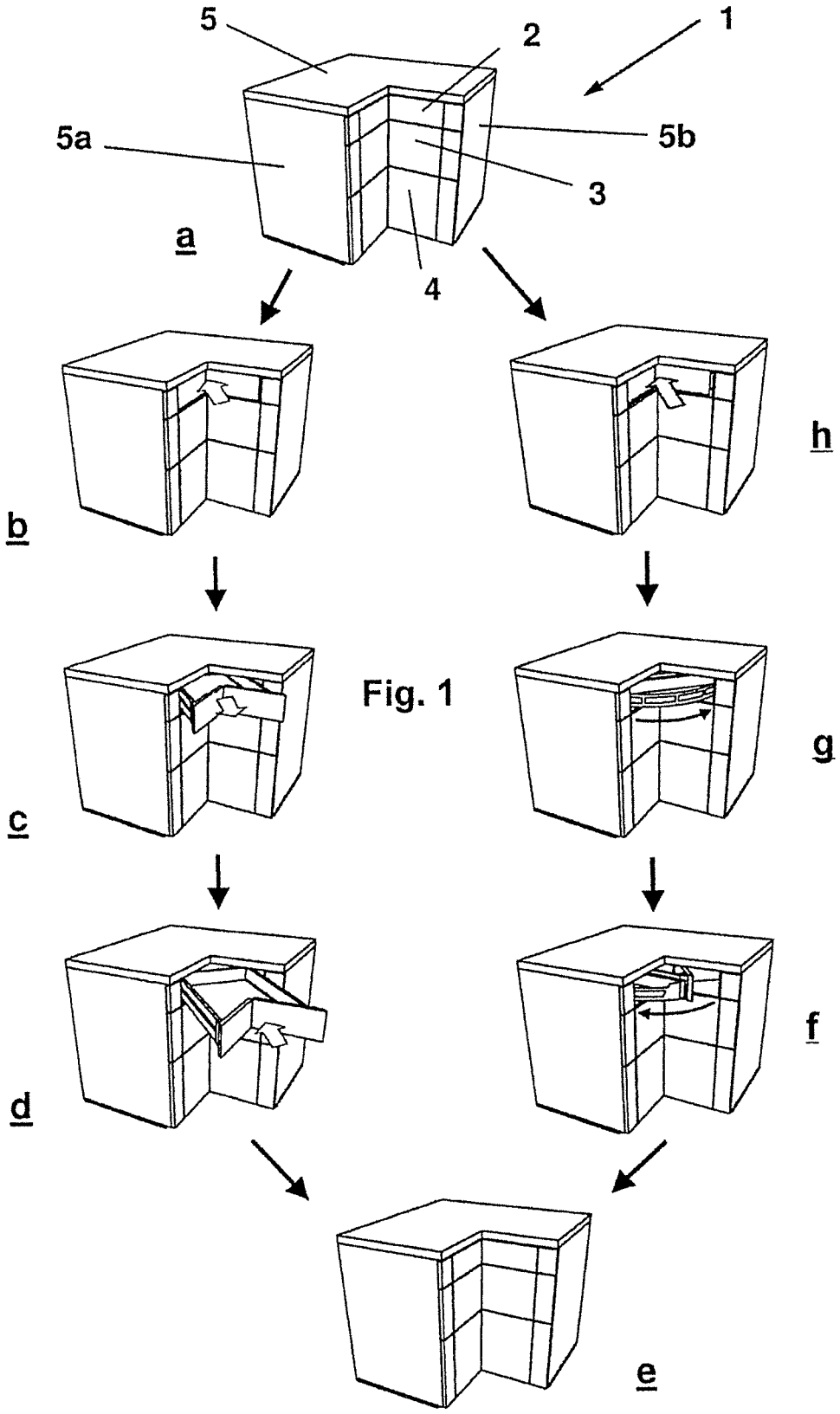
FIG. 1 shows a corner cabinet in various positions.

In the drawings, a rack 10 for a polygonal cabinet 1, preferably a corner cabinet 1, that has an adjusting device 1*a* located on the face end is shown. The corner cabinet 1 has side walls 5*a*, 5*b*, back walls 5*c*, 5*d*, and at least two shelves 14, 15, which are rotatable about an axis 12 and can be slid transversely to the axis 12. The shelves 14, 15 can be operated independently of one another, can be located one above the other, and can be positioned on the shelf support 16. The shelf can be connected to a support 31. The support 31 can be connected operationally to at least back wall 5*c*, 5*d* and/or one stationary brace S located opposite the adjusting device 1*a*.

As seen in FIG. 5*a*, the support 31, essentially an L-shaped support 31 with flanges 31*a*, 31*b*, is connected operationally to the back walls 5*c*, 5*d*, for instance by screws. A rotary mount 8 is positioned in the middle of the support 31. When there are two or more shelf supports, accordingly many supports 31 are located one above the other, each supporting one mount 8.

In FIG. 1, a corner cabinet 1 with a top panel 5 and side walls 5*a* and 5*b* is shown. The face end of the corner cabinet is interrupted inward vertically and is formed by the facings 2, 3 and 4 and the associated shelves (drawers).

If a slight force is exerted on one of the facings 2, 3, 4 (in the example, the uppermost facing 2) in the direction of the arrow (FIG. 1*b*), then the drawer unlocks itself and moves out of the corner cabinet (FIGS. 1*c*, 1*d*). If in the position in FIG. 1*d* force is exerted in the direction of the arrow, the drawer assumes the position shown in FIG. 1*e*.

If initially higher force is exerted in the direction of the arrow on the facing 2 of the corner cabinet (FIG. 1*h*), then the drawer is slid slightly inward, so that the facing 2 of the drawer is no longer in alignment with the interrupted face end of the corner cabinet. In this position, the uppermost drawer together with the shelf support can be rotated about the vertical axis (FIGS. 1*g*, 1*f*). If the drawer is rotated into the original position (FIG. 1*h*) and pressed slightly, then the drawer together with the facing 2 assumes the position in FIG. 1*e*. Optionally, the mechanism can also be embodied in such a way that the facing, after being rotated and upon reaching the position shown in FIG. 1*h*, automatically snaps out and assumes the position in FIG. 1*e*.

Figure 2:
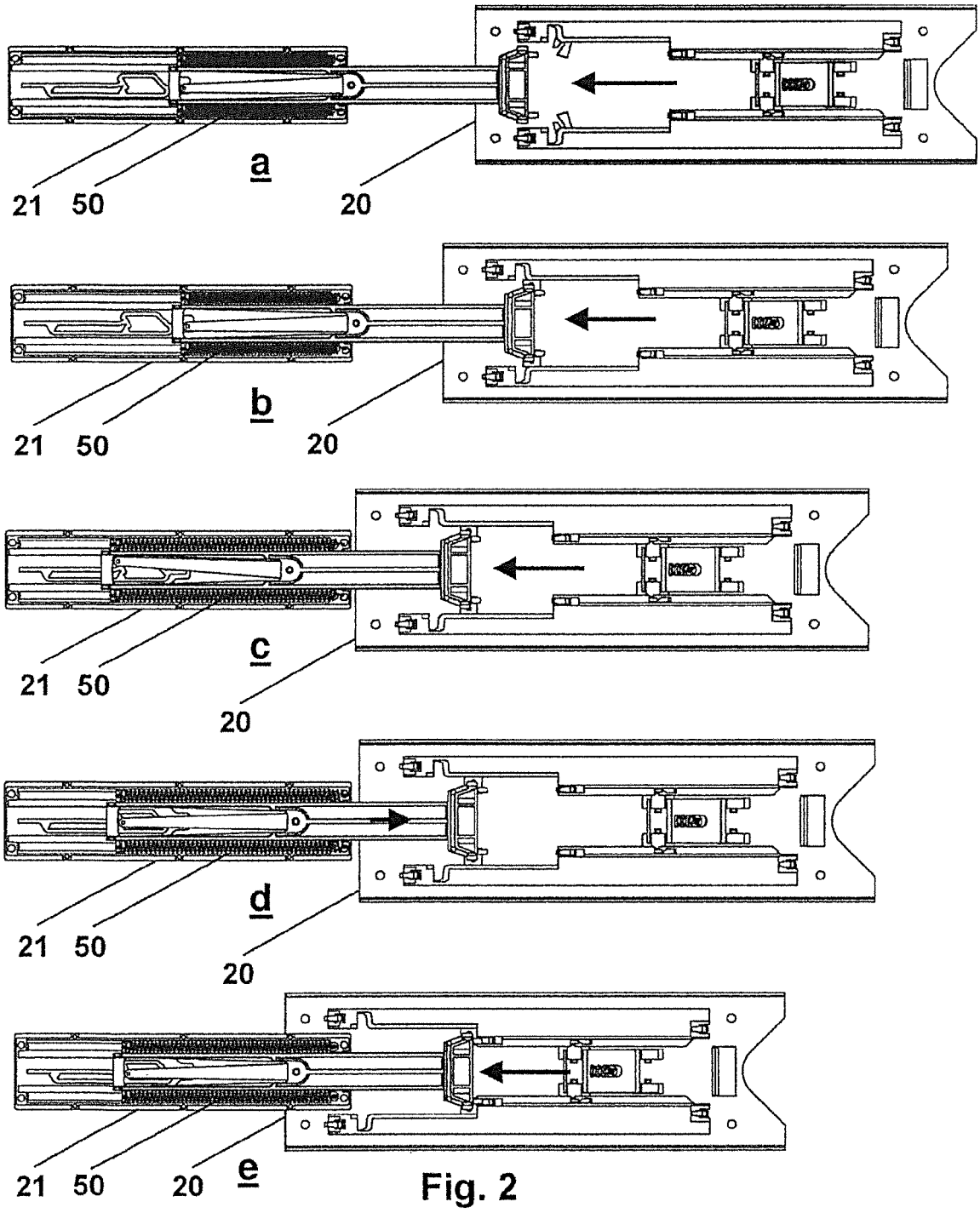
FIG. 2 shows an adjusting device in various operating positions.

In FIG. 1 together with FIG. 2, the position of the uppermost drawer is shown as an example upon operation. If the drawer is in its resting position (FIGS. 1*a*, 1*e*, 2*c*), then the drawer upon operation of the facing 2 can both be slid into the corner cabinet and slid out of the cabinet. Whether the drawer is slid inward or outward depends on the force with which the facing 2 is pressed in the direction of the arrow. The shelf supports are operatively connected to the spring-loaded adjusting device 20, 21 (FIG. 2), and the adjusting device 20, 21 can assume a plurality of operating positions. When pressed slightly while not in action (FIGS. 1*a*, 1*e*, 2*c*), the adjusting device 20, 21 is unlocked, in that it moves a short distance inward in the direction crosswise to the axis of rotation and then, because of the spring loading, is moved outward (FIG. 2*d*), so that the uppermost drawer assumes the position shown in FIGS. 1*d*, 2*a*. Upon the next operation of the facing 2 in the direction of the arrow (FIG. 1*d*), the drawer is slid inward, counter to the action of the spring 50 (FIGS. 2*a*, 2*b*), into its original position (FIGS. 1*a*, 1*e*, 2*c*). If the facing 2 is conversely pressed more forcefully when not in action (FIGS. 1*a*, 1*e*, 2*c*), then it is moved inward in the direction crosswise to the axis of rotation and is locked in a position that makes it possible to rotate the shelf.

Figure 3:
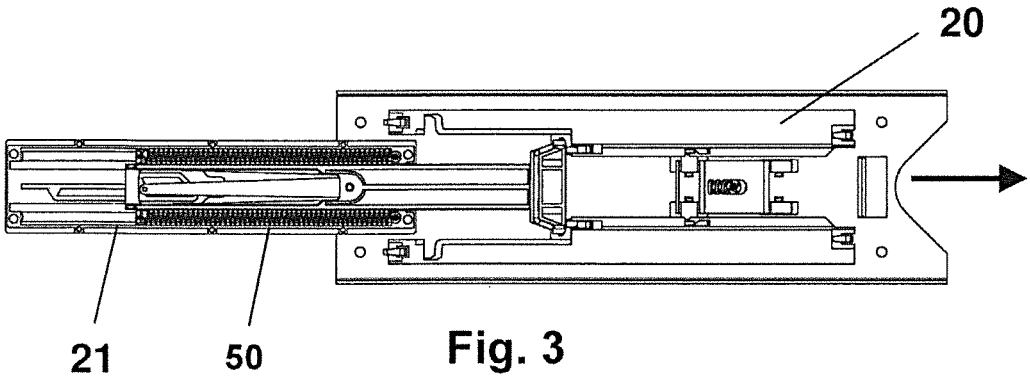
FIG. 3 shows the adjusting device in a vertical top view.
Figure 4:
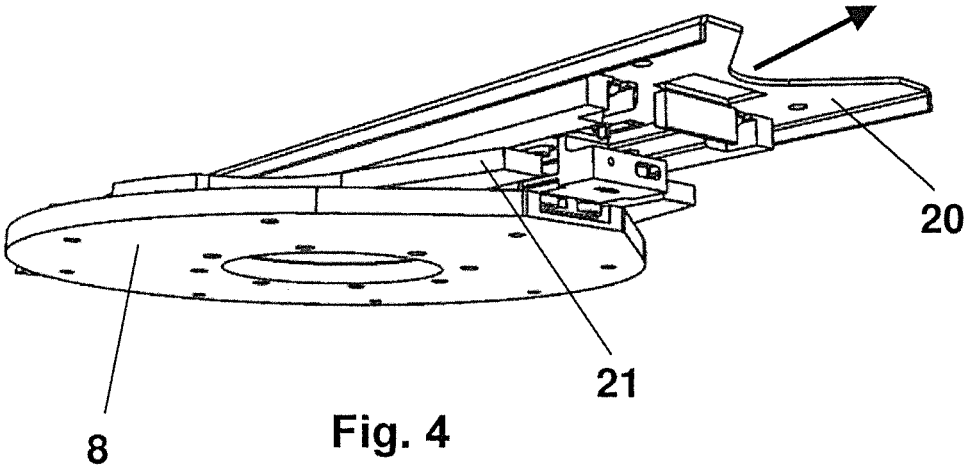
FIG. 4 shows the adjusting device of FIG. 3 with a rotary mount in a perspective side view.

If the uppermost drawer has already been slid inward (FIGS. 1*h*, 2*e*), the drawer can be moved by slight pressure on the facing 2 into its position when not in action (FIGS. 1*a*, 1*e*, 2*c*). FIG. 3 also makes this clear. The adjusting device 20, 21 together with the rotary mount 8 can be seen from FIG. 4.

Figure 5:
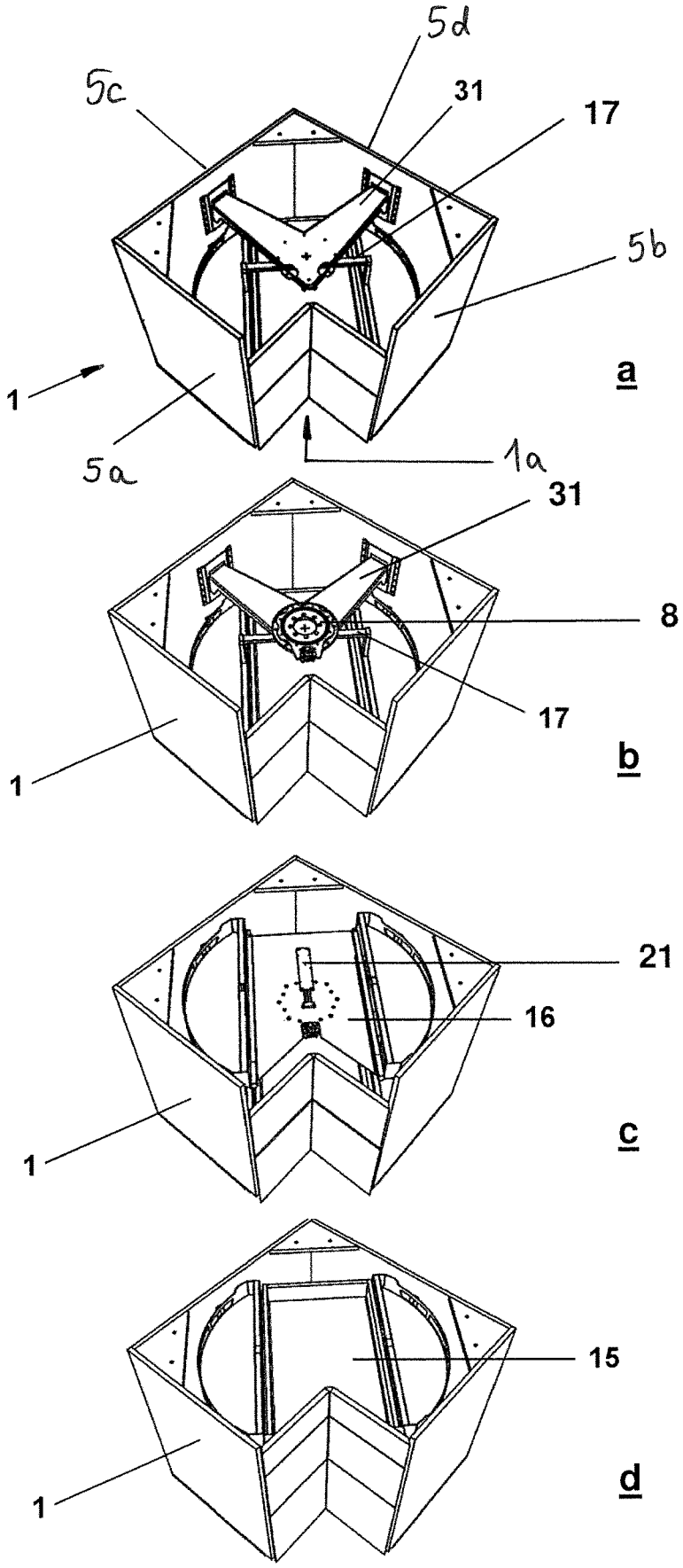
FIG. 5 shows the corner cabinet, shown in FIG. 1, in various stages of its construction.

In FIG. 5, the structure of the shelf carousel when it is open is shown. FIG. 5*a* shows the corner cabinet 1 with a lower shelf support together with a drawer. A bracket 17 is located on the shelf support, and above it is a support 31, which is embodied with two flanges. This support can be secured at an adjustable height to auxiliary supports, which are either embodied in one piece with rear walls 5*c*, 5*d* of the cabinet 1 or are embodied such that they can be located on these rear walls. A mount 8 for the second shelf support is located on the support 31 (FIG. 5*b*). The bracket 17, via a separable mount, not shown, movably braces the support 31.

This mount can for instance consist of a slide or roller mount and can be located on either the bracket 17 or the support 31.

In FIG. 5*c*, the support 31 and the mount 8 of the second shelf support 16 are covered by the lower part, located thereon, of the adjusting device 21, and in FIG. 5*d*, the shelf support 16 has a shelf 15.

Figure 6:
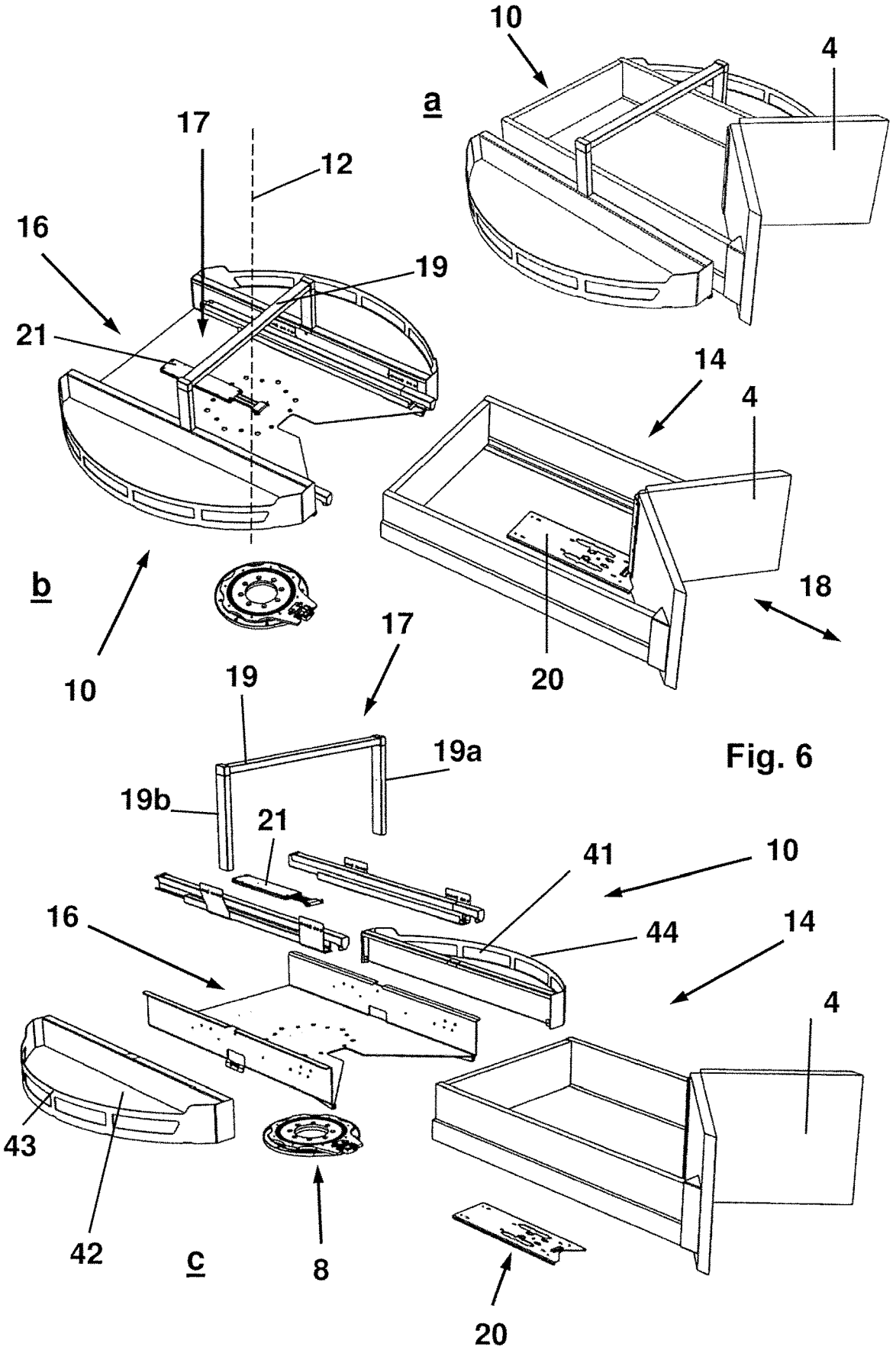
FIG. 6 shows a shelf support with a shelf in the starting position, in the pulled-out position of the shelf, and in an exploded view.
Figure 9:
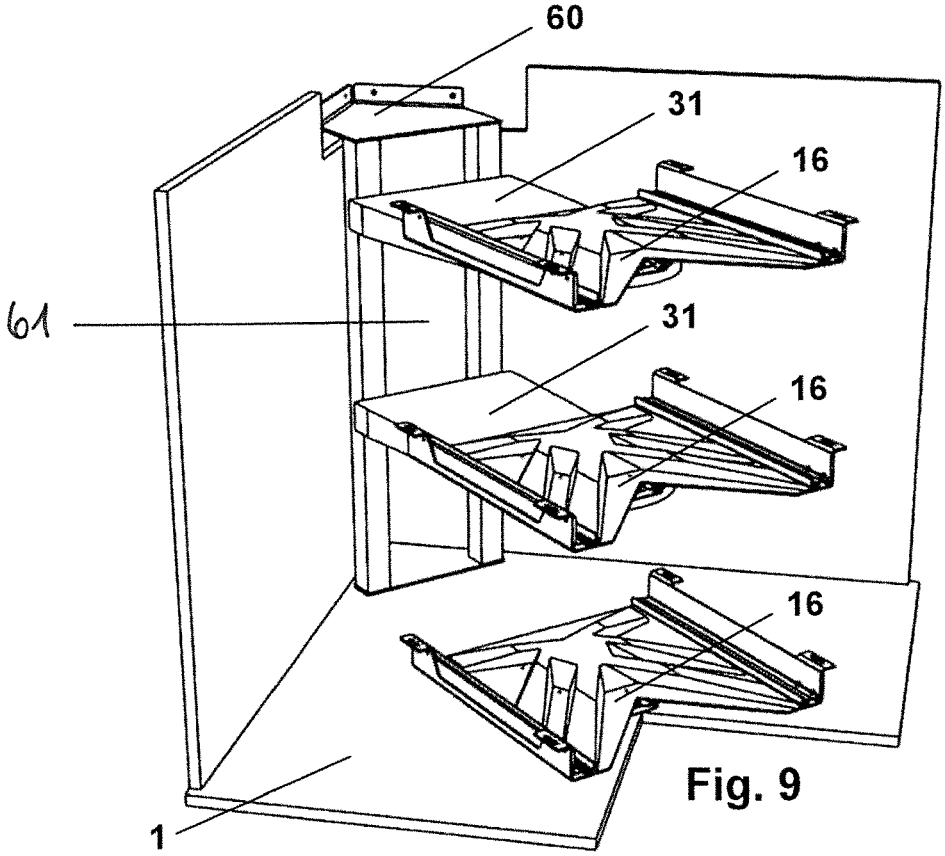
FIG. 9 shows the corner cabinet of FIG. 8 with a shelf located on the vertical fastening element.

In FIGS. 6 and 7, the lower and upper shelves 14, 15 are shown with a bracket 17 and a shelf support 16, respectively. The rack 10 of the invention as a rule has two or more shelves 14, 15 that are rotatable about an axis 12 and can be slid transversely to the axis 12. The shelves 14, 15 can be operated independently of one another and can be fixed in three different positions. The individual positions of the drawer 14, 15 are defined by an adjusting device 20, 21 when it is operated. The drawer 14, 15 is movable in the direction of the double arrow 18, and the respective operating position is defined by the adjusting device 20, 21 shown in FIGS. 3 and 4 as well as in FIG. 2. The lower shelf support 16 has a bracket 17, the horizontal flange 19 of which is located at a slight spacing from the support 31, as shown in FIG. 9. The bracket 17 is essentially U-shaped, and its vertical flanges 19*a*, 19*b* are secured in stationary fashion on the shelf support 16. The support 31 supports the rotary mount 8 and is braced via its flanges 32, 33 on the walls of the corner cabinet. Located laterally from the shelf support 16 are auxiliary shelves 41, 42, whose sides 43, 44 that face away from the shelf are embodied with a curvature. Via a separable mount (slide bearing or roller bearing), not shown, the bracket 17 movably braces the support 31, which is located between the two, and hence on the bracket 17 and/or the support 31.

Figure 8:
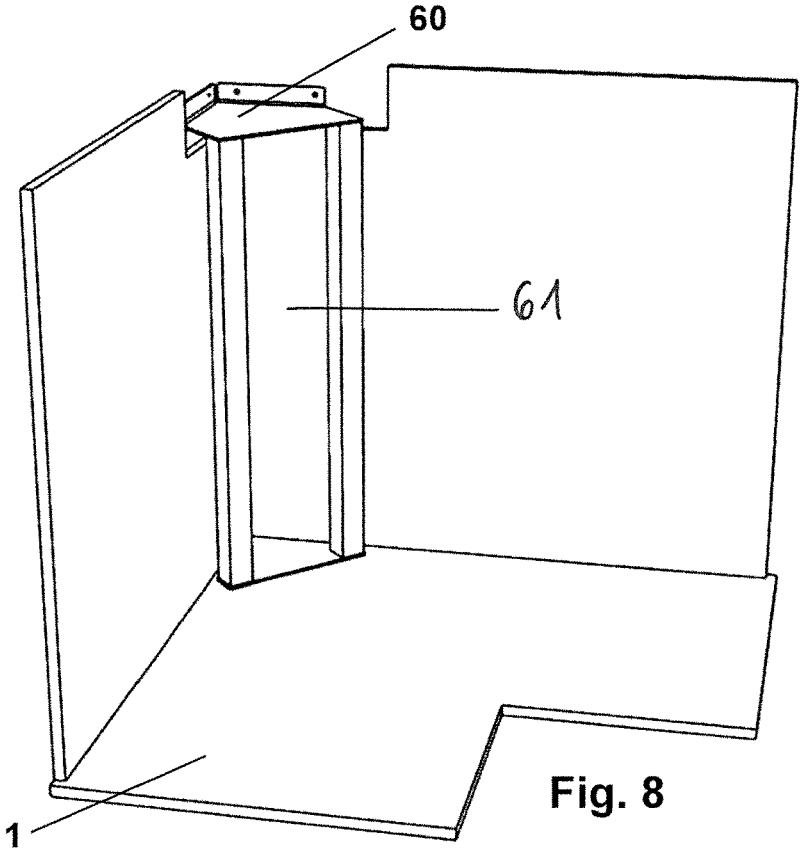
FIG. 8 shows the rear region of a corner cabinet with a vertical auxiliary support of the support.

FIG. 8 shows a retention means 61 (column), which can be secured at least partially, for instance by an upper end 60, directly onto a rear building wall or other stable wall. As a result, the retention means 61 (column) has increased stability compared to the retention device describe in conjunction with FIG. 5. One part of the retention means 61 can also be secured to one part of the cabinet 1.

FIG. 9 shows an alternative variant of the support 31, which in this case is embodied as a rectilinear support 31, and which is secured to the vertical auxiliary support. Because of the greater stability of the auxiliary support and as a consequence of the support 31, it is not necessary to use the bracket 17 to increase the stability of the support system. One shelf support 16 is located on each support 31.

Figure 10:
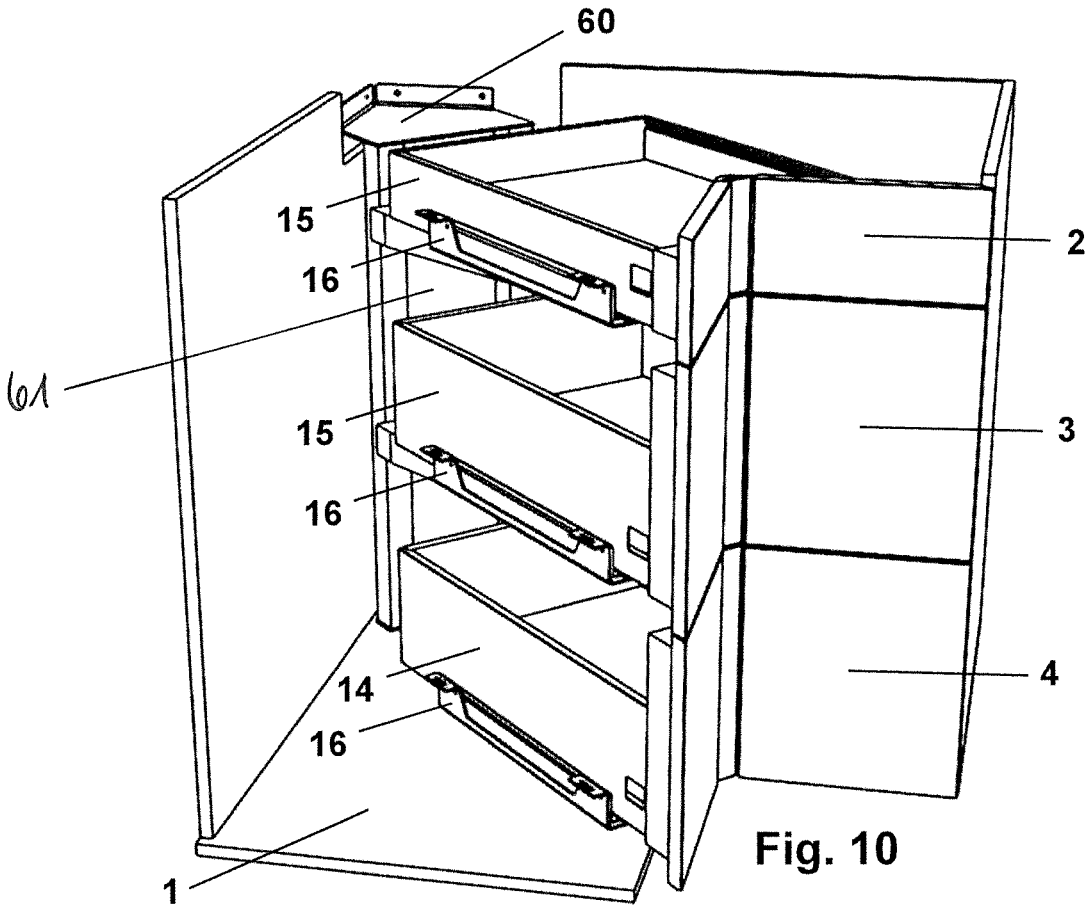
FIG. 10 shows the corner cabinet of FIG. 9 with facings mounted on the shelves.

Like FIG. 9, FIG. 10 also shows the location of shelves 14, 15 on the shelf supports 16.

Figure 11:
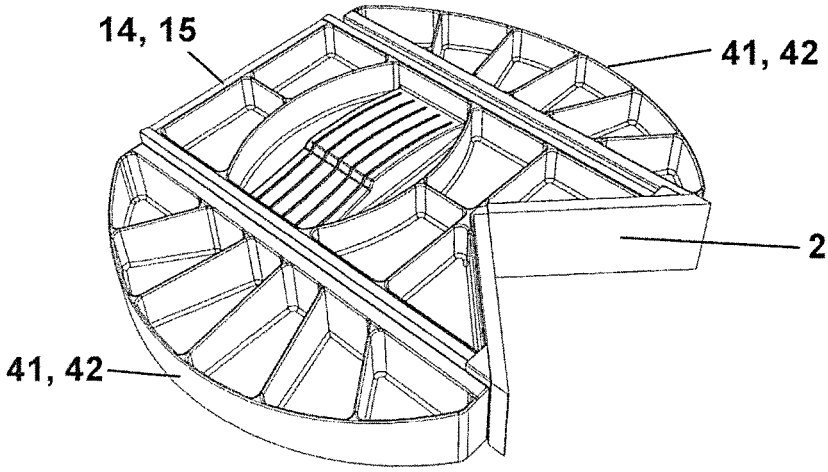
FIGS. 11, 12, 13 show various embodiments of the shelf support with shelves.
Figure 12:
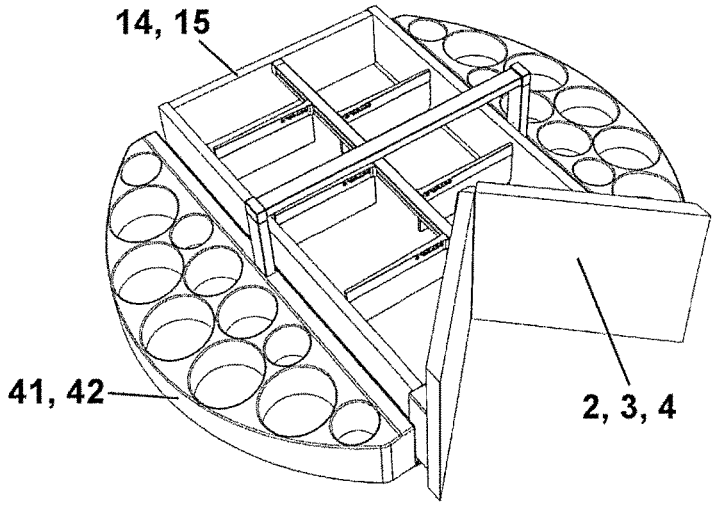
Figure 13:
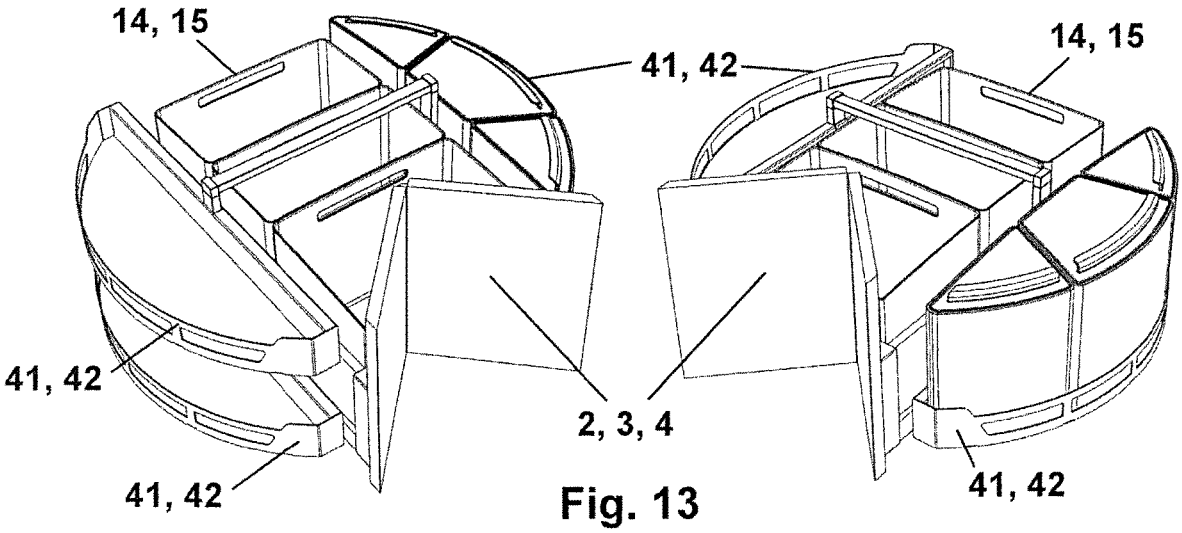

In FIGS. 11, 12, 13, various embodiments of shelf supports 16, shelves 14, 15, and auxiliary shelves 41, 42 are shown.

The proposed rack therefore makes it possible for the entire interior of the corner cabinet to be used, without affecting the external appearance of the corner cabinet. The technical embodiment of both the shelf support 16 and the shelves 14, 15 makes it possible for the rack (the shelf carousel) to function regardless of how many drawers 14, 15 are located one above the other. The drawers 14, 15 can also have different heights. This makes it possible for the drawers 14, 15 to accept maximum loads while being fully movable.

The invention claimed is:

1. A rack (10) for a polygonal cabinet (1), preferably corner cabinet (1), that has an adjusting device (1*a*) located on its front side, having side walls (5*a*, 5*b*), back walls (5*c*, 5*d*), and at least two shelves (14, 15), said rack having two or more shelves being rotatable about an axis (12) and slidable transversely to the axis (12) and which is operable independently of one another, said shelves disposed one above the other and positioned on shelf supports (16), said shelf supports (16) being retained by a support (31) that is operationally connected to at least one back wall (5*c*, 5*d*) and/or to a stationary brace in the form of a column (61) located diametrically opposite the adjusting device (1*a*), said shelf supports (16) are arranged one above the other, with a lower shelf support having a bracket (17) arranged thereon with which a shelf support above and shelf are supported wherein, the bracket (17) has a supporting flange (19) extending transversely to the axis (12) and perpendicular flanges (19*a*, 19*b*), and the bracket (17) is located such that the shelf (15) above the bracket is braced by the load action.

2. A rack (10) for a polygonal cabinet (1), preferably corner cabinet (1), that has an adjusting device (1*a*) located on its front side, having side walls (5*a*, 5*b*), back walls (5*c*, 5*d*), and at least two shelves (14, 15), said rack having two or more shelves being rotatable about an axis (12) and slidable transversely to the axis (12) and which is operable independently of one another, said shelves disposed one above the other and positioned on shelf supports (16), said shelf supports (16) being retained by a support (31) that is operationally connected to at least one back wall (5*c*, 5*d*) and/or to a stationary brace in the form of a column (61) located diametrically opposite the adjusting device (1*a*), said shelf supports (16) are arranged one above the other, with a lower shelf support having a bracket (17) arranged thereon with which a shelf support above and shelf are supported;

said shelf supports (16) are supported by mounts;

wherein, the mounts consist of a slide mount or a roller mount, and the mounts can be secured to the support (31) or to the bracket (17).

* * * * *